United States Patent [19]

Martin et al.

[11] Patent Number: 4,778,059

[45] Date of Patent: Oct. 18, 1988

[54] EASY-OPEN SHIPPING CARTON WITH IMPROVED TEAR STRIP ARRANGEMENT

[75] Inventors: John R. Martin, Crawfordsville; Herbert W. Rieke; William R. Larmore, both of Indianapolis, all of Ind.

[73] Assignee: Inland Container Corporation, Indianapolis, Ind.

[21] Appl. No.: 86,099

[22] Filed: Aug. 17, 1987

[51] Int. Cl.[4] ..... B65D 5/54

[52] U.S. Cl. ..... 206/631; 206/606; 206/627; 206/609

[58] Field of Search ..... 206/631, 633, 606, 608, 206/627, 629

[56] References Cited

U.S. PATENT DOCUMENTS

| | | | |
|---|---|---|---|
| 3,276,666 | 10/1966 | Johnson | 229/51 |
| 3,300,118 | 1/1967 | Owens | 206/606 |
| 3,302,851 | 2/1967 | Johnson | 206/606 |
| 3,343,747 | 9/1967 | Molins | 229/51 |
| 3,362,617 | 1/1968 | Gieber | 206/631 |
| 3,402,876 | 9/1968 | Kuchenbecker | 229/51 |
| 3,409,206 | 11/1968 | Slouka et al. | 229/51 |
| 3,502,257 | 3/1970 | Virros | 229/51 |
| 3,504,844 | 4/1970 | Stark et al. | 206/631 |
| 3,727,750 | 4/1973 | Petter | 206/46 |
| 3,873,017 | 3/1975 | Blatt | 229/41 |
| 3,884,348 | 5/1975 | Ross | 206/45 |
| 4,093,069 | 6/1978 | Smolderen | 206/455 |
| 4,113,100 | 9/1978 | Soja et al. | 206/606 |
| 4,621,736 | 11/1986 | Roccaforte | 206/606 |

FOREIGN PATENT DOCUMENTS

| | | | |
|---|---|---|---|
| 545601 | 9/1959 | Canada | 206/606 |
| 421806 | 4/1967 | Switzerland | 206/606 |

*Primary Examiner*—Willis Little

*Attorney, Agent, or Firm*—Fitch, Even, Tabin & Flannery

[57] ABSTRACT

A cardboard shipping carton is provided with an improved easy-open tearing arrangement. Body panels of the shipping carton have a conventional corrugated paperboard construction. A tear tape of material different from the corrugated paperboard is secured to the inside of the body panels with adhesive. A severing line generally opposite the tear tape is associated with each body panel. The appearance of the exposed edge is improved by providing border tape on an outside surface of each body panel with an upper edge of the outer tape aligned with the severing line. Preferably, a bottom edge of the tear tape is positioned below the top edge of the border tape, to provide a lower display portion. Also disclosed is a pull tab providing access to the tear tape from outside the carton. The pull tab is formed by cutting a portion of the body panel adjacent the tear tape to provide a pull tab having angled edges in opposing panel portions, on either side of the tear tape, which are inclined towards the tear tape in the general direction in which the tear tape is to be pulled.

16 Claims, 3 Drawing Sheets

EASY-OPEN SHIPPING CARTON WITH IMPROVED TEAR STRIP ARRANGEMENT

BACKGROUND OF THE INVENTION

1. Field of the Invention

The present invention pertains to corrugated shipping cartons and, in particular, to corrugated shipping cartons having tear strips and the like for dividing the shipping carton into two portions, one of which is particularly suitable for display purposes.

2. Brief Description of the Prior Art

In many retail stores today, goods shipped in corrugated cartons are conveniently set up for display by removing an upper portion, leaving a tray-like container holding some or all of the goods shipped in the carton. While it is a relatively simple operation to sever a corrugated cardboard shipping carton with a knife to form a display tray, this operation presents a risk of injury to a person cutting the box and to the goods inside if the depth of the cut is not accurately controlled. Further, during a cutting operation, the knife blade tends to wander from side to side, leaving a non-uniform wavy or ragged edge with detracts from the appearance of the display tray so formed.

For these and other reasons, there is a demand for easy opening shipping cartons having a tear string, tear tape, or other tear strip which, when pulled through the outer wall of a shipping carton performs the desired severing operation. For example, U.S. Pat. No. 3,884,348 discloses a corrugated cardboard shipping carton having a tear strip located along medial walls of the carton for severing them to provide a display container. In order to minimize strain on the tear strip, and to more accurately control tearing, the outer wall of the shipping carton is perforated along the path of tearing, on either side of the tear strip. This arrangement, however, requires reinforcing construction to minimize strain on the perforations tending to induce unintentional severing of the shipping carton prior to arrival at its destination point or prior to its intended display.

Another arrangement for minimizing the strain when severing with a tear strip, is given in U.S. Pat. No. 3,727,750, which is directed to a sterile package for medical products and the like. The tear strip disclosed therein is formed as a portion of a laminated outer wall of the paper board package. The tear strip is defined by dual pairs of score lines in the inner and outer surfaces of the paperboard package. To prevent the intrusion of unwanted materials into the package through the score lines and to provide an easy opening tearing operation, pulling on the tear strip causes a delamination between inner and outer sets of score lines formed on the inner and outer laminations, respectively. This construction suffers from the same disadvantages pointed out above, namely, the score lines introduce a weakening in the package. A similar arrangement of dual pairs of score-lines on opposing surfaces of a shipping carton are given in U.S. Pat. No. 3,502,257. The arrangement differs from that preceding, in that a single layer of cardboard forms the outer wall.

Pairs of weakening lines are also present in the tray-forming container of U.S. Pat. No. 3,276,666. The weakening lines herein are formed on the inside liner or surface of the corrugated container material. Several steps are taken in order to induce the desired weakening effect. For example, the weakened lines are interrupted at intervals and a reinforcing tape is attached to the outside liner of the container, which also assists in providing an even tearing. The tear strip, formed between weakening lines, as a portion of the inner liner, is pulled through the outer liner of the carton. The weakening along parallel spaced-apart lines on the inner liner of the container decreases container strength.

In order to provide shipping containers of greater strength and containers having a generally tubular appearance, U.S. Pat. No. 3,873,017 provides a triple-walled polygonal construction. A tear strip is provided between the middle and outer layers adjacent one end of the container to provide access to the interior thereof. This construction is, in general, not well suited for forming a display device.

In addition to cardboard shipping containers, pull strips, pull strings or the like are found in a variety of different types of packages. For example, U.S. Pat. No. 4,093,069 discloses a cardboard envelope surrounding a stack of sheet materials. Interfitting half portions of the envelope, when mated, form an enclosed interior. A tear strip, preferably with a row of perforations is provided in the cardboard envelope to provide easy tearing in a direction generally transverse to a seam joining the two portions.

At times, it is desired to reuse the container in which goods are shipped. U.S. Pat. No. 4,621,736 provides a reclosable paperboard carton having a tear string attached to an inside liner of the carton wall. The tear string, when drawn through the carton wall, divides the carton into a lid and a container portion. The container portion, when squeezed at its open end, allows interfitting within the lid portion to thereby provide a reclosing feature. To assist in severing the two carton portions, partial cuts are made in the outside liner of the carton material, a feature which, as pointed out above, weakens the strength of the carton. As an alternative to the tear string, the inside liner of the carton material may be cut along a pair of spaced, parallel lines to thereby form a tear strip from the inner liner material, in a manner similar to that described above.

In addition to rectangular or polygonal cardboard shipping containers. tear strings and the like are frequently found in cylindrical container bodies for frozen juice concentrate and the like. As a first example, U.S. Pat. No. 3,409,206 provides an improvement in the pull-strip tearing of one end of a cylindrical paper body by forming the cylindrical body from specially fabricated overlapping paper layers having fibers which are aligned relative to the direction of tearing. The fibers, aligned in an overlapping relationship, are oriented such that pulling of the tear strip causes an upstream fiber to pick up its neighboring overlying downstream fiber. The tearing is assisted by lines of weakness in both inner and outer wall surfaces of the paper wall. A second example of this general type of container is shown in U.S. Pat. No. 3,402,876, which assists the tearing operation by providing an enlarged pull tab which is generally formed separately from the container wall. A perforated line of weakness assists in the tearing. This container, as well as other containers for fruit juice concentrate and other liquid materials, typically requires a lamination of a variety of materials, the inner lamination layer typically providing a liquid-tight barrier of plastic, foil, or the like non-paper material. Corrugated cardboards, in general, are not employed in containers of this type.

Some containers are so fragile that they do not require lines of weakness formed by perforation, slits or the like, in the container material to guide or assist in reducing the effort required to pull a tear strip. For example, U.S. Pat. No. 3,343,747 is directed to a cellophane outer wrapper for soft cigarette packs. Tear strips, generally formed of plastic, are secured to the cellophane wrapper with adhesive. Since the cellophane offers minimal resistance to tearing, no weakening lines are required.

SUMMARY OF THE INVENTION

It is therefore an object of the present invention to provide a corrugated cardboard shipping carton, the walls of which are not weakened by score lines, lines of perforation or the like.

Another object of the present invention is to provide an easy-open tearing arrangement for a corrugated cardboard shipping carton having a pull tape formed of material different from that of the carton material.

Yet another object of the present invention is to provide an improved pull tab for a corrugated cardboard shipping carton which is formed from the carton wall, offering improved control, particularly during the initial stages of tearing.

Still another object of the present invention is to provide a corrugated cardboard shipping carton with an improved tear strip arrangement which provides a neat, attractive edge after tearing, suitable for use as the exposed edge of a display tray or the like.

These and other objects of the present invention, which will become apparent from studying the appended description and drawings, are provided in a cardboard shipping carton having improved means for severing the carton so as to provide a display portion thereof having a finished edge.

The carton consists of at least one corrugated paperboard body panel located medially between first and second panel end means, and a corrugated medium disposed between inside and outside wall-like liners. A severing line associated with the body panel defines first and second panel portions on either side of the severing line adjacent the first and second panel end means, respectively. A tear tape, located on the inside liner, has first and second edges adjacent the first and the second panel end means, with the second edge of the tear tape generally extending in the direction of and positioned adjacent to the severing line. A border tape located on the outside liner has first and second edges adjacent the first and second panel end means, with the first edge thereof generally extending in the direction of the severing line and positioned adjacent thereto.

In this arrangement, when the tear tape is pulled in the direction of the severing line, at least one body panel is severed into first and second portions, a finished edge of the second portion is provided at the first edge of the border tape, with the second panel portion and second panel end comprising the display portion.

Other objects of the present invention are provided in a pull tab for accessing a tear tape. These and other features are provided in a cardboard shipping carton having improved means for severing the carton so as to provide a display portion thereof having a finished edge, and at least one corrugated paperboard body panel in a medial location in the carton between first and second panel end means, with the body panel having a corrugated medium disposed between inside and outside wall-like liners.

A severing line associated with at least one body panel defines first and second panel portions on either side of the severing line adjacent the first and second panel end means, respectively.

A tear tape on the inside liner has first and second edges adjacent the first and second panel end means, with the second edge of the tear tape generally extending in the direction of and positioned adjacent to the severing line. Graspable pull tab means are affixed to a portion of the tear tape and formed in the body panel so as to provide access to the tear tap from outside the carton. The pull tab means has a first, free end remote from the tear tape and a second end including a pair of generally converging lines extending generally in the direction of the severing line, one line on either side of the tear tape to assist in initiating the tearing of the body panel.

BRIEF DESCRIPTION OF THE DRAWINGS

In the drawings, wherein like elements are referenced alike.

DETAILED DESCRIPTION OF PREFERRED EMBODIMENT

Figure 1:
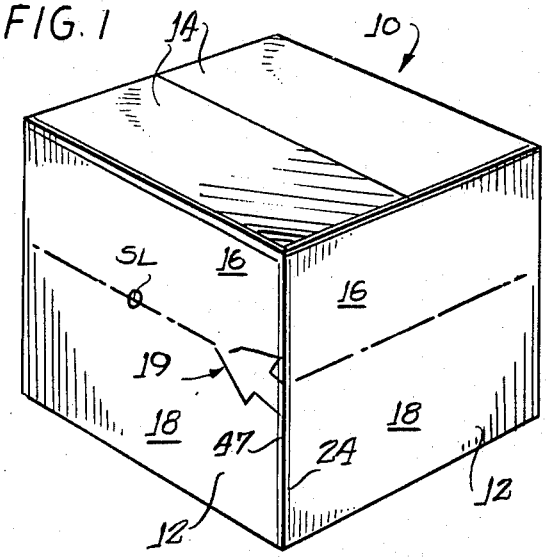
FIG. 1 is a perspective view of the shipping carton having a pull tab constructed according to one embodiment of the present invention.
Figure 2:
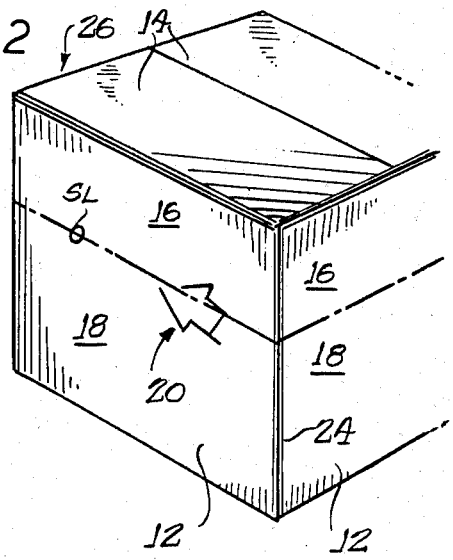
FIG. 2 is a perspective view of a shipping carton having an alternative pull tab construction according to a second embodiment of the present invention.

Referring now to the drawings, and in particular to FIG. 1, a corrugated cardboard shipping container 10 is shown including four body panels 12 each having an associated end wall 14. The broken line in FIG. 1 identified by the designator "SL" represents a severing line extending across the various body panels 12, dividing each body panel into first and second, upper and lower portions 16, 18, respectively. For example, the body panel 12 in which a pull tab 19 is formed, has an upper first portion 16 adjacent an upper end wall flap 14. Although not visible in the view of FIG. 1, the corresponding second, lower portion 18 has a similar end wall flap. As will be explained in greater detail below with respect to FIG. 3, a manufacturer's joint 24 is formed by overlapping body panels at one corner of the container, which is prominently shown in FIG. 1. For ease of manufacture, pull tab 19 is preferably located adjacent the joint 24. As an alternative, the pull tab 20 may be located in the middle of a body panel, as illustrated in FIG. 2, which shows a pull tab 20 in the center of one panel of carton 26. This arrangement is generally less preferable in that the die-cut operation for forming pull tab 20 is not located at an edge of the carton blank.

Figure 3:
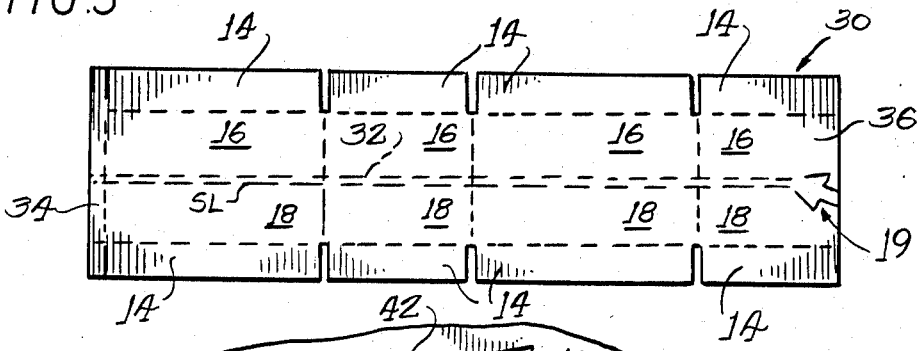
FIG. 3 is a plan view of a carton blank used to construct the carton of FIG. 1.

With reference to FIG. 3, a carton blank is generally indicated at 30. The corrugated cardboard material for the carton blank 30 is of conventional construction wherein a corrugated cardboard medium is located between two wall-like paperboard liners which are secured thereto with adhesive. When used to form a container of single-ply construction, the liners form paper sheet-like inner and outer surfaces of the cardboard panels. As indicated in FIG. 3, a tear strip 32 is attached to the inner surface or inner liner of the container 10 of FIG. 1. Not visible in the carton constructions of FIG. 1 and FIG. 2 is a joining tab 34, located at one end of the carton blank. When the blank 30 is folded to form a tubular member, the free end 36 thereof is covered by the overlying joining tab 34 and is secured thereto with adhesive, staples, or the like. Precautions must be taken when using adhesive to make the box manufacturer's joint, since the joint underlies pull tab 19. Preferably, pull tab 19 should not be joined to tab 34 unless the adhesive seal at that point is easily broken. It is generally preferred that either the inside surface of pull tab 19 or the corresponding portion of tab 34 be masked or otherwise coated with a material that prevents or weakens the adhesion of pull tab 19 to an underlying carton layer. After the box manufacturer's joint is completed, the end walls 14 are inwardly folded in a customary overlapping relationship to complete the construction of the container. Thus, when fully assembled, the tear strip 32 is located on an inside surface of the container panels and is utilized to gain entry into the enclosed interior of the container when it is pulled through the inner liner, corrugated medium, and outer liner of the container panels thereby separating each panel into the aforementioned upper and lower portions 16, 18.

Figure 4:
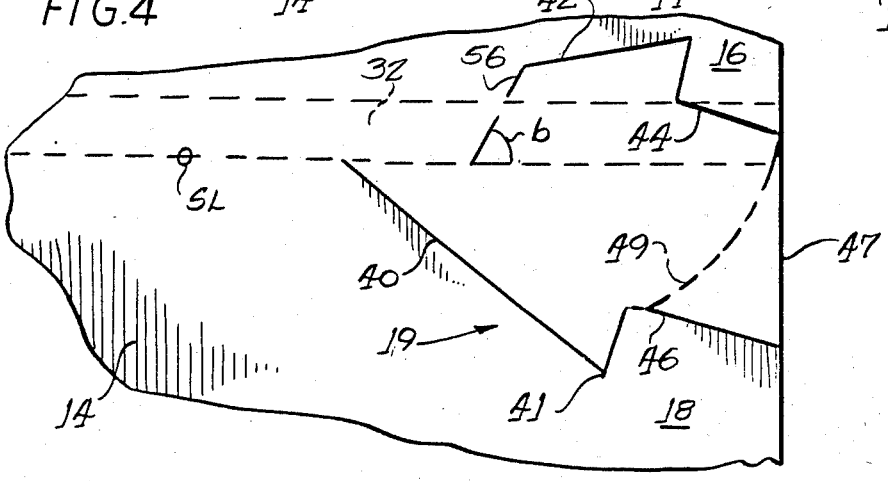
FIG. 4 is a fragmentary view of FIG. 1 showing the pull tab in greater detail.

Referring now to FIGS. 1 and 4, easy access to the tear strip 32 is provided from the outside of box 10, by a pull tab 19 constructed according to one embodiment of the present invention. As indicated, pull tab 19 has a generally truncated arrowhead appearance, wherein the tip of the arrowhead is formed by non-intersecting converging lines. FIG. 4 shows arrowhead pull tab 19 for use at a panel edge and has a relatively simple tail construction formed by two parallel lines.

Figure 5:
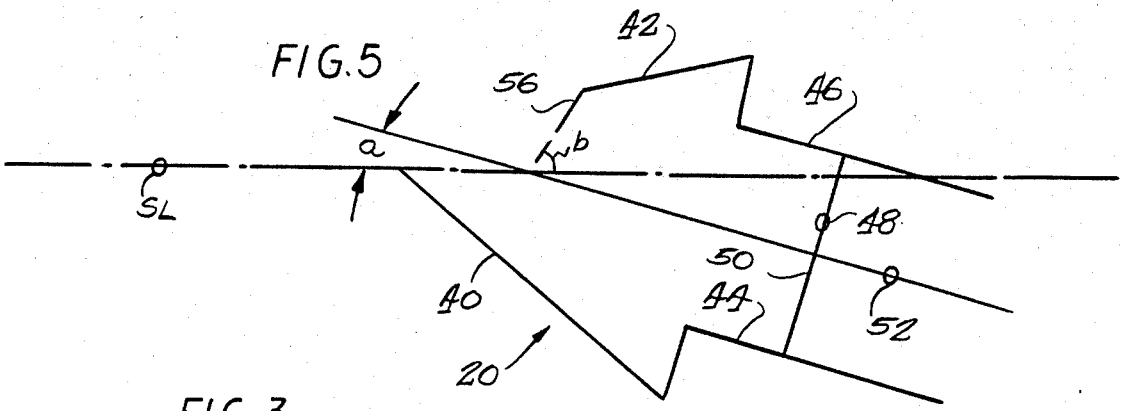
FIG. 5 is a simplified schematic representation of the pull tab of FIG. 2.

A similar arrowhead pull tab 20 for use in the middle of a carton panel is shown in FIG. 5. As will be explained, access to the pull tab 20 of FIG. 5 is provided at the tail of the arrowhead by a "butterfly-like" construction. Except for the tail constructions, pull tabs 19, 20 are identical. As will be seen, various options applicable to both pull tabs 19, 20 are provided.

Pull tabs 19, 20 are preferably formed in a die-cutting operation performed on the carton blank after tear strip 32 is glued thereto. According to one aspect of the present invention, the tear strip 32 is of a "co-material" construction, that is, tear strip 32 is preferably formed from a material different from that of the carton. Preferably, an inexpensive tear strip construction utilizes a plastic ribbon, at least 0.005 inches in thickness and about ¼ inches in width, formed from high tensile strength plastic material. The tear strip described is adequate to tear the panels of boxes having a 275 lb. test rating. As shown in FIGS. 3 and 4, tear strip 32 is indicated by phantom lines, since it adheres to the remote, inner liner of the corrugated cardboard medium. The arrowhead-like construction of the pull tabs is indicated by solid lines which represent a cut extending through all three layers of the corrugated cardboard medium, that is, the inner and outer layers as well as the corrugated medium. Hereafter, this type of cut will be described as a "full cut."

Referring to FIG. 4, the converging lines of the arrowhead, 40, 42, extend in the general direction of tearing, along severing line SL. Located behind the arrowhead are parallel, full cuts 44, 46, with the latter also severing the tear strip 32. To pull tab 19, the user lifts the end 47 of the pull tab tail, located at the edge of the carton panel. The user then pulls the tab generally in the direction indicated by the arrowhead shape, and thereafter along the severing line as well. The tear strip 32, joined to the inside surface of the pull tab, follows the movement thereof so as to tear the carton panels into upper and lower portions. As mentioned above, care must be taken to avoid adhering pull tab 19 to underlying carton layers in a way which prevents a user from lifting the edge 47 thereof. Referring again to FIG. 4, the reference numeral 49 is applied to an optional, generally arcuate cut line defining the tail and free end portion of pull tab 19. The arcuate cut line 49, when employed, is preferably a full cut extending through both liners as well as the corrugated medium of the container panel. When the optional arcuate cut line 49 is employed, the lower parallel cut line 46 is omitted and the upper portion of the arcuate cut line is positioned to meet the upper full cut 44 at the edge 47 of the carton panel. Alternatively, the arcuate cut line 49 allows the pull tab 19 to be located at a corner of the carton not having the manufacturer's glue joint. Access to the free end of the pull tab is gained by deflecting the lower carton portion 18 adjacent the arcuate cut line, allowing a user to grasp and separate the pull tab in the direction indicated by its arrow-like construction.

One particular advantage of the pull tab construction illustrated in FIG. 4 is that the severing line can now be located very close to the bottom end wall of the container, and in one embodiment, is located as close as 1 inch to the bottom end wall. Referring to FIG. 4, the bottom corner 41 of the arrowhead can be located immediately adjacent the fold line defining the corner between side panel and bottom end panels of the container to provide, upon tearing, a lower panel portion 18 of minimum height.

Reference will now be made to FIG. 5 to describe pull tab 20 in greater detail. However, the same features are also included in pull tab 29 of FIG. 4. According to other aspects of the preferred embodiment of the present invention, the arrowhead cut line 42, a full cut extending through the first, upper panel portion 16, extends generally in the direction of severing line SL (that is, the direction in which the tear strip 32 is to be pulled), but is terminated with an end portion 56 angled toward the tear strip 32 and forming an angle b with the severing line SL which ranges between 45 and 90 degrees, and preferably has a value closer to 45 degrees. The end portion 56 offers improved control over the initial tearing of the corrugated cardboard, and particularly the outer liner thereof. It has been noted in some instances that, without the end portion 56 as described above, the initial line of tearing follows neither the full cut 42 of the arrowhead nor the general direction of the severing line SL, but rather tends to wander in a generally "wavy" manner about the severing line. The end portion 56, although relatively small compared to the full cut 42 of the arrowhead, causes the initial torn portion of the corrugated cardboard to more closely follow the intended direction of the severing, resulting from drawing the tear strip 32 through the corrugated cardboard.

As indicated in FIG. 4, the free end of the cut portion 56 and of the cut line 40 lie as close to the opposing edges of tear strip 32 as is possible, given the tolerances of a commercial manufacturing operation. It is preferred, if tear strip 32 is formed of a plastic material which is easily fractured if nicked, that the free ends of the arrowhead cut lines 40, 56 either be slightly spaced from the edges of the tear strip or be formed from "low knife" cuts such as cut portion 62 of FIG. 6, which penetrate only the outer liner and at most the corrugated medium, but do not also penetrate the inner panel liner, as in a full cut. However, if the tear strips are formed of material which can tolerate a nick at their outer edges without slitting, fracturing, or tearing of the material when a tensile load is applied thereto, the gap between the arrowhead cut lines and the tear strip edges can be reduced as desired. Referring to FIG. 4, the severing line SL is indicated as coinciding with the bottom edge of tear strip 32, although the severing line could as well be associated with the opposing upper edge of tear strip 32 or along any parallel lines adjacent or overlying the tear strip.

Turning again to FIG. 5, a schematic diagram of pull tab 20 of FIG. 2 is shown in greater detail. As mentioned above, the pull tab 20 is identical to the previously-described pull tab 19, except for the tail pottion of the arrowhead, with each tail construction being optimized for its particular location in a carton panel. The pull tab 20 has a tail section including the parallel, full cuts 44, 46. However, the pull tab 20 is distinguished by a transverse full cut 48 extending between medial portions of the parallel cuts 44, 46, to form what is generally referred to as a "butterfly" construction, having a familiar "H" pattern. To grasp pull tab 20, the user inserts a finger by pushing along transverse cut line 48 to grasp the tab-like free end or tail 50 of the tab which is enclosed on its three sides by cuts 44, 46 and 48. Thereafter, the user pulls the tab generally in the direction indicated by the arrowhead shape and then along the severing line SL. The tear strip 32, as a result of the above-described construction, is joined to the inside surface of pull tab 20 and is free to follow the movement thereof, having been slit during formation of the butterfly portion, adjacent the tail of the arrowhead. The initial point of tearing, adjacent the tip of the arrowhead, is at the opposite end of the pull tab from the tail, where the pull tab is, at least initially, grasped. As mentioned above, the initial tearing is aided by cut portion 56.

Referring again to FIG. 5, according to one aspect of the present invention, the axis 52 of pull tab 20 is formed at an angle a to the severing line SL, ranging generally between 10 and 25 degrees, and is preferably less than 30 degrees. According to other aspects of the preferred embodiment of the present invention, at least a part, but preferably the major portion, of the pull tabs 19, 20 is formed in the second panel portion 18 and is pointed toward the other first panel portion 16, but generally in the direction of tearing along the severing line SL. Consequently, the angle a is preferably an acute angle.

In general, the above-described arrangement of pull tab and tear strip is generally satisfactory if one wants to gain entrance to the interior of a container without regard for the appearance of the container portions formed after severing. However, as described above, it is frequently desired to form at least one of the portions of the container having, a neat, attractive, exposed edge suitable for display devices which, for example, are tray-like in appearance.

Figure 6:
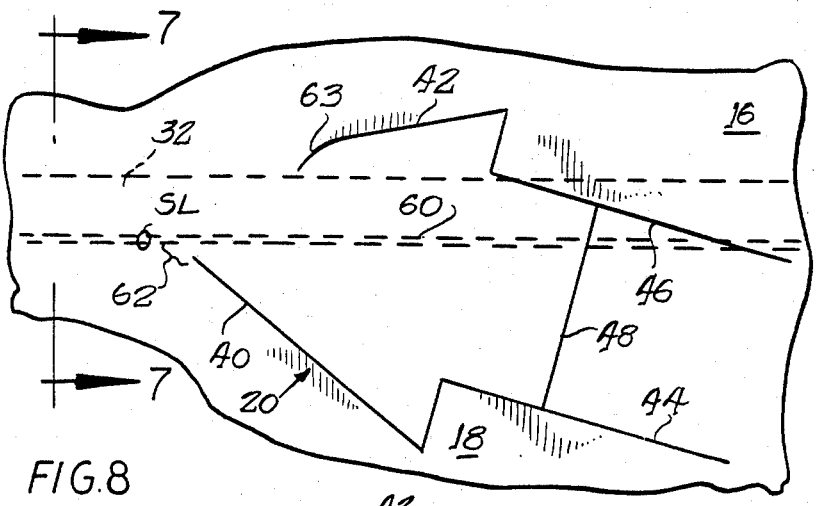
FIG. 6 is an elevational view of a pull tab construction similar to that of FIG. 5 but having a line of weakness applied to the outside liner of the corrugated cardboard blank.
Figure 7:
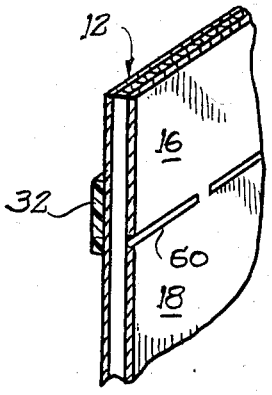
FIG. 7 is a fragmentary perspective view in cross-section taken along the line 7—7 of FIG. 6 and looking in the direction of the arrows.

In order to provide an attractive finished edge to the lower panel portions 18 of the carton, a weakening line 60 is formed in the carton walls as indicated in FIGS. 6 and 7. Preferably, the line of weakness 60 overlies (i.e., is positioned between the edges of) tear tape 32, and preferably is located slightly above the bottom edge of the tear tape. When the tear tape is advanced along the severing line, the bottom edge thereof tends to pull the inner liner and corrugated medium in an upward direction so as to meet the line of weakness 60 on the outer liner. The line of weakness 60 may, for example, be formed by perforation, or by a "low knife" cut which extends through the outer liner add may extend into all or a portion of the corrugated medium, but in any event does not extend into the inner liner. The line of weakness 60 is represented in FIGS. 6 and 7 by a dashed line, to indicate either a perforation or a low knife cut which are equivalent for the purposes of describing the preferred embodiment of the present invention as illustrated in FIG. 6.

As indicated by the reference numeral 62, an optional low knife cut portion may be provided as an extension of the arrowhead cut line 40. The low knife cut portion extends the arrowhead to the severing line SL (which coincides with the line of weakness 60), without risk of nicking the underlying tear strip 32. That is, the low knife cut 62 penetrates only through the outer liner of panel 12 and at most only through the corrugated medium, but not through the inner liner. The low knife cut 62 can, if desired, be made considerably longer than that illustrated in FIG. 6. For example, the low knife cut can extend a considerable distance into the upper panel portion 16, and can overlie the entire width of tear strip 32, since it does not come in contact therewith.

Referring again to FIG. 6, another alternative end portion at the upper arrowhead cut line is identified by the reference numeral 63. The end portion 63 as opposed to the end portion 56 of FIG. 5, is generally arcuate, or part circular in form. For example, end cut 63 comprises the portion of a circle having a ⅛" radius.

Figure 8:
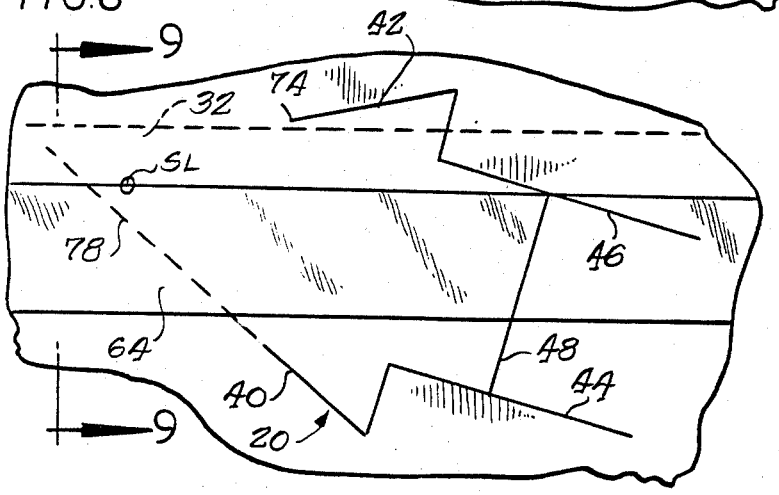
FIG. 8 is an elevational view of a carton panel having an alternative easy-open tearing arrangement including a border tape applied to the outside liner of the corrugated cardboard panel.
Figure 9:
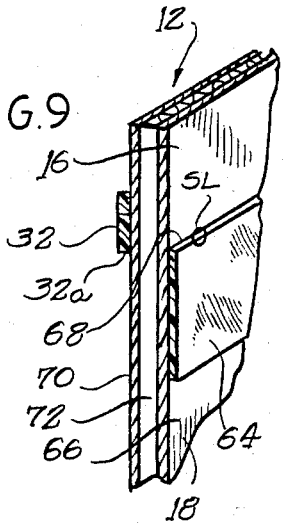
FIG. 9 is a fragmentary perspective view taken in cross-section along the line 9—9 of FIG. 8.

Though the above-described arrangement of FIG. 6 provides a relatively "clean" and neat exposed edge of the lower panel portion 18, even more attractive edges are sometimes required. Also, the line of weakness 60 weakens the body panels in which it is formed and, depending on contents carried in the carton, may be objectionable for this reason. To provide further improvements as illustrated in the following FIGS. 8–14, a border tape 64 is provided on the outer liner 66 of the body panel 12. In the first embodiment of the present invention, the bottom edge 32*a* of tear strip 32 is arranged in registry with the top edge 68 of a border strip or tape 64, as is shown in FIGS. 8 and 9. The border tape 64 is preferably made of plastic material such as MYLAR or acetate. As with the tear tape, border tape 64 is preferably applied to the carton blank, with a suitable adhesive. In the illustration of FIG. 9, the thickness of the pull tape and border tape is greatly exaggerated, for purposes of clarity. Also, the border tape is illustrated as being much wider than the tear tape, although the relative widths can vary greatly, and can even be reversed (interchanged) if desired. While the width of the pull tape is directly related to its pulling strength and therefore its desired function, only the upper edge of the border tape has a significant impact on its function.

As the tear strip 32 is pulled through the inner liner 70, corrugated medium 72 and outer liner 66, an exceptionally clean, neat edge of the second, bottom panel portion is provided at the top of border tape 64. According to one aspect of the present invention, the border tape 64 is, at least at its upper edge, rigid enough to resist bending of its upper edge as the tear strip is eventually pulled through the outer liner 66. As with the border tape described above with reference to FIGS. 8 and 9, no line of weakness is necessary in the inner liner, corrugated medium, and especially the outer liner, border tape 64 alone being relied upon to provide an extremely neat and attractive edge exposed at the upper edge of border tape 64.

In FIG, 8, the arrowhead cut line 42 is illustrated having an optional terminus, devoid of the end portion features 56, 63 as described above with reference to FIGS. 4, 5 or 6. Such features could, if desired, be added in the manner indicated above. The other, lower arrowhead cut line 40 is extended by a low knife cut 78, the major purpose of which is to allow freedom of movement in the direction of severing line SL.

Figure 10:
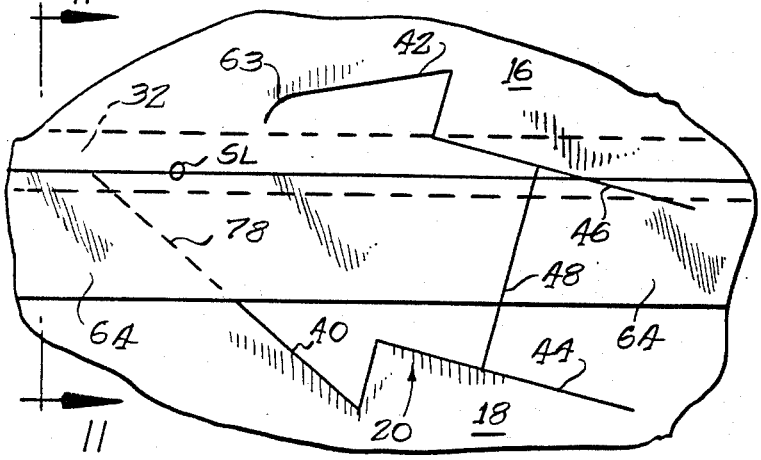
FIG. 10 is an elevational view of a carton panel similar to that of FIG. 9 but having a different relative orientation between the tear strip and border tape.
Figure 11:
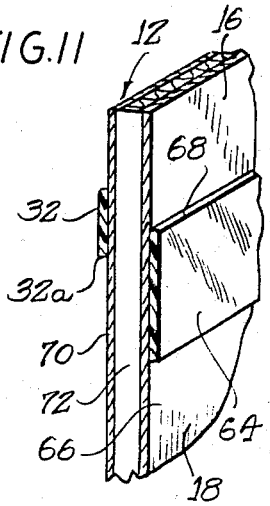
FIG. 11 is a fragmentary perspective view in cross-section taken along the line 11—11 of FIG. 10 and looking in the direction of the arrows.

Referring now to FIGS. 10 and 11, an alternative arrangement, similar to that of FIGS. 8 and 9 is shown. The principal diffrrence is that the tear strip 32 has its bottom edge 32*a* located a significant distance below the top edge 68 of border tape 64. In general, the lowering of tear tape 32 according to FIGS. 10 and 11 assures a neat, attractive tearing at the upper edge 68 of border tape 64, which virtually eliminates wandering of the actual line of severing away from the intended severing line SL as indicated in the figures.

Figure 12:
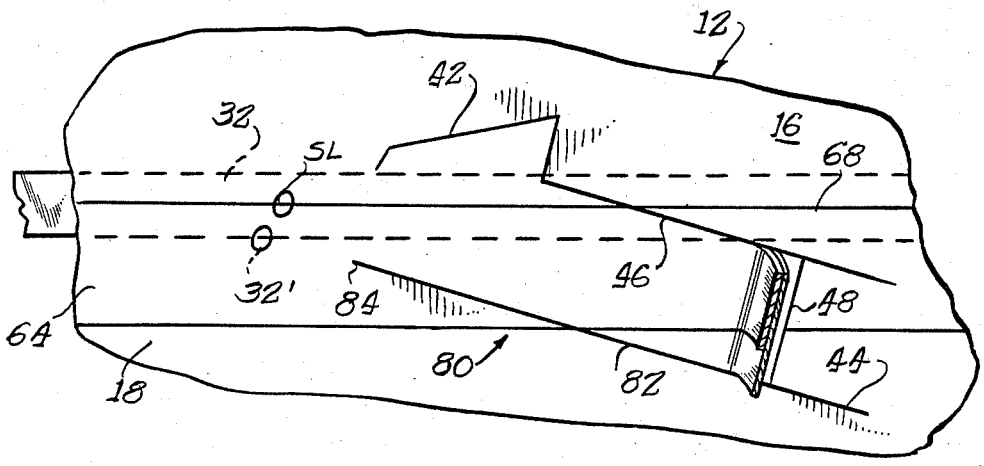
FIG. 12 is an elevational view of a carton panel having an alternative pull-tab design and a border tape applied to its outer liner.

Referring now to FIG. 12, a variation of the pull tab 20 is shown comprising an upper half, generally resembling a half-arrowhead, and a lower straight line cut portion 82. More specifically, FIG. 12 shows a pull tab 80 having an upper full cut 42 which extends towards and generally in the direction of severing line SL, as indicated above. The principal difference between pull tab 80 and pull tab 20 described above, is the lower cut line 82 which in the embodiment illustrated in FIG. 12, comprises a straight line rather than a mirror image 40 of the arrowhead outline formed in upper panel portion 16. The terminus 84 of cut line 82 is located immediately adjacent the lower edge 32*a* of tear tape 32. However, a low cut extension such as extension 62 as described above in FIG. 7 is preferably employed to provide further severing of the border tape 64, eliminating the uncut gap between the terminus 84 and the severing line or upper edge 68 of the border tape. This feature is especially desirable when the border tape is difficult to tear. The "butterfly" cuts 44, 46, 48 are the same as described above, and the exact placement of the transverse cut 48 of the butterfly portion is not critical, and need not overlay the border tape or tear tape, if desired.

Figure 13:
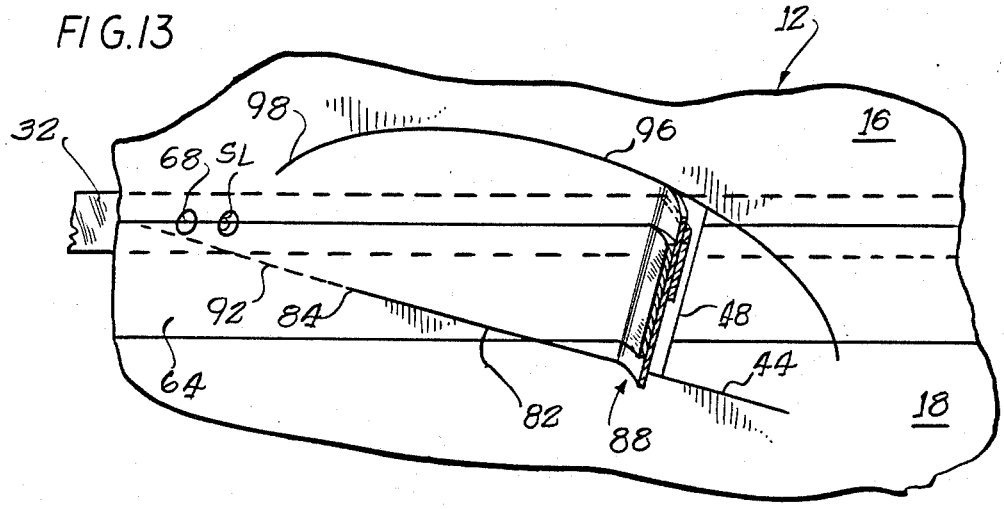
FIG. 13 is an elevational view of a carton panel having another alternative pull-tab configuration.

Referring now to FIG. 13, another alternative embodiment of a pull tab 88 is illustrated having a full-cut lower straight line 82 as described above with respect to FIG. 12. A low knife cut 92 extends between the terminus 84 of full cut 82 and the upper edge 68 of border tape 64 adjacent the severing line SL. The principal distinguishing feature of pull tab 88 is the upper, arcuate full cut 96. The upper full cut 96 as illustrated is generally ellipsoid in shape, although other convenient arcuate shapes such as paraboloid and other configurations may be employed. The upper full cut 96 as in the other pull tab arrangements illustrated, extends into both upper and lower portions 16, 18 of panel portion 12. The terminus 98 of full cut 96 is adjacent the severing line, and preferably forms an angle with the severing line at least as great as 45 degrees, as explained above. A butterfly portion (44, 48 and 96) allows access to the pull tab 88 as generally described above.

Figure 14:
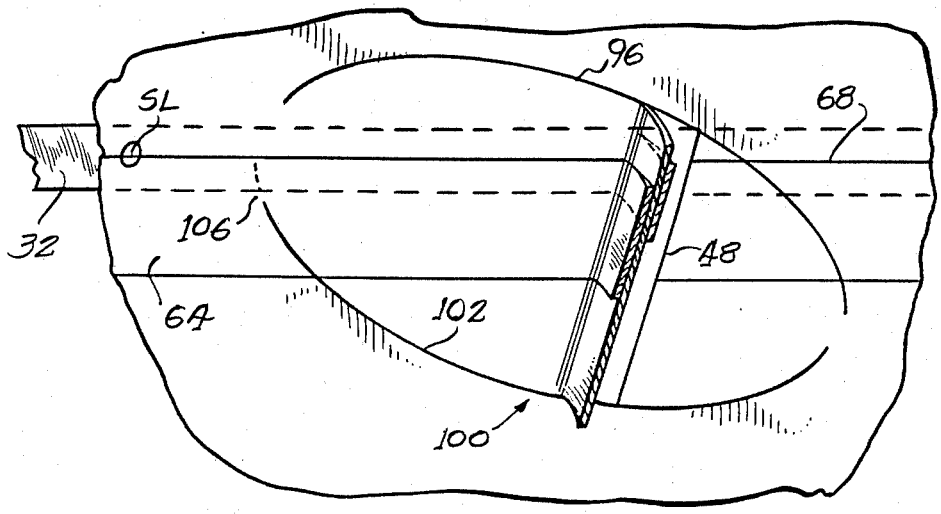
FIG. 14 is an elevational view of a carton panel having yet another alternative configuration of a pull-tab.

Referring now to FIG. 14, a further alternative embodiment of a pull tab 100, according to the present invention, illustrated. The pull tab 100 is substantially similar in many aspects to the pull tab 88 of FIG. 13. The principal difference is in the lower full cut line 102 which is generally arcuate, and as illustrated in one embodiment, is a mirror image, ellipsoid configuration. A low knife cut extension 106 of lower cut line 102 is provided to avoid nicking the edge of tear tape 32 is a feature which, as pointed out above, is particularly advantageous when tear strip 32 is made of material which is easily torn, a characteristic not uncommon of thin plastic strips which are strong in tension as long as a "fault line" is not present to initiate lateral tearing under tension.

Referring now to the pull tabs in general, according to one aspect of the present invention, the longitudinal or major axis of the arrowhead, ellipse, or other configuration formed by the cut lines, lies at an acute angle to the severing line which ranges between 10 and 25 degrees, and preferably comprises 15 degrees. In operation, the pull tabs of FIGS. 12, 13 and 14 are essentially identical to that of the pull tab 20 of the preceding figures. The different shapes of the full cut lines forming the different pull tabs are only illustrative of the present invention, and other configurations are, of course, possible. However, the precise positioning of the pull tab relative to the severing line is not particularly critical. In general, it is desirable to cut the outer border tape when present, to minimize the effort required to pull the tear strip in the desired direction. The full cuts forming the pull tabs described herein preferably cut the tear tape as well, allowing a user access to the tear tape so it can be pulled through the body panels. Alternatively, the tear tape need not extend entirely around the perimeter of the container, but can have a gap in the general vicinity of the tail of the pull tab. In this alternative, the cuts forming the pull tab need not be arranged so as to intersect the tear tape or the severing line. Further, it is generally desirable to locate the pull tab such that the tail or free end thereof, initially grasped by a user, overlies the tear tape so that it too is also grasped along with the pull tab. This latter feature, present in FIGS. 13 and 14, for example, is not critical if the strength of adhesion of the tear tape to the cardboard body of the pull tab is adequate to prevent a separation thereof. The pull tab of FIG. 14 does not include the tear tape at its original end adjacent the "butterfly" cuts 44, 46, 48.

Although a tape-like tearing member has been illustrated in the above figures, the present invention contemplates other configurations of tear strips. For example, the tear strip can comprise a string-like member or a rib-like spine having major cross-sectional dimensions extending perpendicular to the container panels.

Further, although the features of the present invention have been illustrated with reference to cartons having distinct, multiple panels separated by defined corners or edges, the present invention can also be applied to cartons having a single, cylindrical body panel. A pull tab associated with the body panel need not be located adjacent any longitudinal or helical seam formed during manufacture of the body panel, although such is generally desirable, for the reasons indicated above.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A cardboard shipping carton having improved means for severing the carton so as to provide a display portion thereof having a finished edge, comprising:

at least one corrugated paperboard body panel in a medial location in said carton between first and second panel end means, said at least one body panel having a corrugated medium disposed between inside and outside wall-like liners;

a severing line associated with said at least one body panel defining first and second panel portions on either side of said severing line adjacent said first and said second panel end means, respectively;

a tear tape on said inside liner having first and second edges adjacent said first and said second panel end means, with said second edge of said tear tape generally extending in the direction of and positioned adjacent to said severing line; and a border tape on said outside liner having first and second edges adjacent said first and said second panel end means, with the first edge thereof generally extending in the direction of said severing line and positioned adjacent thereto;

whereby when said tear tape is pulled in the direction of said severing line to sever said at least one body panel into said first and second portions, a finished edge of said second portion is provided at the first edge of said border tape, said second panel portion in combination with said second panel end means comprising said display portion.

2. The carton of claim 1 further comprising manually graspable pull tab means for providing access to the tear tape from outside the carton to assist at least initially in tearing said at least one body panel into said first and second panel portions.

3. The carton of claim 2 wherein said pull tab means has a body portion at least partially formed from said second panel portion by a cut enclosing a part of said pull tab remote from an initial point of tearing and opening in a direction extending towards said first panel portion.

4. The carton of claim 3 wherein ends of said cut extend generally in the direction of said severing line.

5. The carton of claim 4 wherein one end of said cut lies in said first portion and terminates in a line portion immediately adjacent said severing line so as to form therewith an angle at least as great as 45°.

6. The carton of claim 4 wherein said cut generally has the form of a truncated arrowhead, the tip of which is formed by two non-intersecting converging lines, one in said first panel portion, the other in said second panel portion.

7. The carton of claim 6 wherein said cut line in said first panel portion has an end adjacent said severing line and forming an included angle therewith which is at least as great as 45°.

8. A cardboard shipping carton having improved means for severing the carton so as to provide a display portion thereof having a finished edge, comprising:

at least one corrugated paperboard body panel in a medial location in said carton between first and second panel end means, said at least one body panel having a corrugated medium disposed between inside and outside wall-like liners;

a severing line associated with said at least one body panel defining first and second panel portions on either side of said severing line adjacent said first and said second panel end means, respectively;

a line of weakness defined in said outside liner extending along said severing line;

a tear tape on said inside liner having first and second edges adjacent said first and said second panel end means, with said second edge of said tear tape generally extending in the direction of and positioned adjacent to said severing line;

manually graspable pull tab means affixed to a portion of said tear tape and formed in said body panel so as to provide access to the tear tape from outside the carton and;

said line of weakness and said tear tape cooperating to limit tearing of the body panel at said severing line when said tear tape is pulled outwardly through said body panel to tear at least one of said inside liner and said corrugated medium, whereby an attractive finished edge is formed at said severing line on at least one of said first and said second panel portions.

9. The carton of claim 8 wherein said pull tab means has a body portion at least partially formed from said second panel portion by a cut enclosing a part of said pull tab remote from an initial point of tearing and opening in a direction extending towards said first panel portion.

10. The carton of claim 9 wherein one end of said cut lies in said first portion and terminates in a line portion immediately adjacent said severing line so as to form therewith an angle at least as great as 45°.

11. The carton of claim 9 wherein said cut generally has the form of a truncated arrowhead, the tip of which is formed by two non-interesting converging lines, one in said first panel portion, the other in said second panel portion.

12. The carton of claim 8 wherein said line of weakness comprises perforations cut into said outside liner along said severing line.

13. The carton of claim 8 wherein said line of weakness comprises a continuous cut in said outside liner along said severing line.

14. A cardboard shipping carton having improved means for severing the carton so as to provide a display portion thereof having a finished edge, comprising:

at least one corrugated paperboard body panel in a medial location in said carton between first and second panel end means, said at least one body panel having a corrugated medium disposed between inside and outside wall-like liners;

a severing line associated with said at least one body panel defining first and second panel portions on either side of said severing line adjacent said first and said second panel end means, respectively;

a tear tape on said inside liner having first and second edges adjacent said first and said second panel end means, with said second edge of said tear tape generally extending in the direction of and positioned adjacent to said severing line; and manually graspable pull tab means affixed to a portion of said tear tape and formed in said body panel so as to provide access to the tear tape from outside the carton, said pull tab means having a body portion at least partially formed from said second panel portion by a cut enclosing a part of said pull tab remote from an initial point of tearing and opening in a direction extending towards said first panel portion, said cut lying in said first portion and terminating in a line portion immediately adjacent said severing line so as to form therewith an angle at least as great as 45°, and said body portion having a first, free end remote from said tear tape and a second end including a pair of generally converging lines extending generally in the direction of said severing line, one line on either side of said tear tape to assist in initiating the tearing of said body panel.

15. A cardboard shipping carton having improved means for severing the carton so as to provide a display portion thereof having a finished edge, comprising:

at least one corrugated paperboard body panel in a medial location in said carton between first and second panel end means, said at least one body panel having a corrugated medium disposed between inside and outside wall-like liners;

a severing line associated with said at least one body panel defining first and second panel portions on either side of said severing line adjacent said first and said second panel end means, respectively;

a tear tape on said inside liner having first and second edges adjacent said first and said second panel end means, with said second edge of said tear tape generally extending in the direction of and positioned adjacent to said severing line; and manually graspable pull tab means affixed to a portion of said tear tape and formed in said body panel so as to provide access to the tear tape from outside the carton, said pull tab means including a body portion having a first, free end remote from said tear tape and a second end including a pair of generally converging lines extending generally in the direction of said severing line, one line on either side of said tear tape to assist in initiating the tearing of said body panel, and said body portion at least partially formed from said second panel portion by a cut enclosing a part of said pull tab remote from an initial point of tearing lnd opening in a direction extending towards said first panel portion, said cut generally having the form of a truncated arrowhead, the tip of which is formed by two non-intersecting converging lines, one in said first panel portion, the other in said second panel portion.

16. The carton of claim 15 wherein said cut line in said first panel portion has an end adjacent said severing line and forming an included angle therewith which is at least as great as 45°.

* * * * *

UNITED STATES PATENT AND TRADEMARK OFFICE

CERTIFICATE OF CORRECTION

PATENT NO. : 4,778,059

DATED : October 18, 1988

INVENTOR(S) : John R. Martin

It is certified that error appears in the above-identified patent and that said Letters Patent is hereby corrected as shown below:

On the face of the patent, under the title, "FOREIGN PATENT DOCUMENTS," change the issue date of the Canadian Patent from "9/59" to --9/57--.

At col. 7, line 45, change "pottion" to --portion--.

At col. 8, line 33, change "add" to --and--.

At col. 9, line 43, change "diffrrence" to --difference--.

At col. 10, line 26, after "invention", insert --is--.

At col. 10, line 32, Per 1.312 Amendment, after "32" insert a comma and delete "is".

At col. 12, line 60, change "non-interesting" to --non-intersecting--.

Signed and Sealed this

Sixteenth Day of May, 1989

*Attest:*

DONALD J. QUIGG

*Attesting Officer*

*Commissioner of Patents and Trademarks*